US005823073A

United States Patent [19]

Tickner

[11] Patent Number: 5,823,073

[45] Date of Patent: Oct. 20, 1998

[54] TUBULAR FLUORESCENT LAMP TOOL

[75] Inventor: Jerold A. Tickner, Phoenix, Ariz.

[73] Assignee: Transition Lighting, Inc., Phoenix, Ariz.

[21] Appl. No.: 767,536

[22] Filed: Dec. 16, 1996

[51] Int. Cl.[6] ..... H01K 3/32

[52] U.S. Cl. ..... 81/53.11

[58] Field of Search ..... 81/53.1, 53.11; 294/19.1, 14.2, 22, 99.1

[56] References Cited

U.S. PATENT DOCUMENTS

| | | | |
|---|---|---|---|
| 3,143,371 | 8/1964 | Bloch et al. | 81/53.11 |
| 3,799,599 | 3/1974 | Jordan | 81/53.11 |
| 5,379,666 | 1/1995 | Held | 81/53.11 X |

*Primary Examiner*—James G. Smith
*Attorney, Agent, or Firm*—Meschkow & Gresham, P.L.C.; Jordan M. Meschkow; Lowell W. Gresham

[57] ABSTRACT

A tool (20) for manipulation of a tubular fluorescent lamp (22) has a backplane (30), a coupler (32) for attachment to an external extension pole (36), a lamp gripper (38), a lamp extractor (44), and an extraction endpiece (50). The coupler (32) has a mechanism for angular adjustment (34). The lamp gripper (38) has a segmental cylindrical structure (40) with a non-slip inner surface (42) and an inner diameter generally coincident with that of the lamp (22). The lamp extractor (44) has an extraction extension (46) and an extraction stud (48) at the end of the extension (46). The Extraction endpiece (50) has an endcap (52) intended to fit over an end of the lamp (22) and an engagement fork (54) with which to engage the extraction stud (48).

9 Claims, 5 Drawing Sheets

TUBULAR FLUORESCENT LAMP TOOL

TECHNICAL FIELD OF THE INVENTION

The present invention pertains to the handling of lamps. More specifically, the present invention relates to the removal and installation of tubular fluorescent lamps.

BACKGROUND OF THE INVENTION

The practice of removing, installing, or changing tubular fluorescent lamps when those lamps are out of reach of a concerned individual pose several interesting problems, not the least of which are those of convenience and safety.

Standard tubular fluorescent lamps fall into two broad categories: those that require axial-pressure sockets and those that require twist-lock sockets.

Those lamps requiring axial-pressure sockets include the industry-standard "Slimline" T8 (1" diameter) and T12 (1½" diameter) lamps with Fa8 (single-pin) bases, and high-output T8 and T12 lamps with R17d (recessed double-contact) bases, among others. Lamps of this type, hereinafter referred to as axial-pressure lamps, use a socketing method incorporating a fixed socket at one end and a socket with a spring-loaded plunger at the other. Insertion of a lamp is accomplished by engaging a first end of the lamp into the plunger socket, applying an axial force to the lamp of sufficient strength to depress the plunger enough to allow engagement of the second end, engaging the second end, and allowing the plunger's axial spring pressure to hold the lamp in the sockets. Removal of a lamp is accomplished through a reverse process.

Those lamps requiring twist-lock sockets include the industry-standard "Rapid-Start" T8 and T12 lamps with G13 (medium BiPin) bases, among others. Lamps of this type, hereinafter referred to as twist-lock lamps, use a socketing method incorporating two fixed twist-lock type sockets, one at each end. Assuming, for the sake of example, that these sockets are mounted vertically in a lamp-downward position, insertion of a lamp is accomplished by holding the lamp in such a manner as to align the pins on each end of the lamp vertically. Next, one pin on each end of the lamp is inserted into each socket as far as it will go while rotating the lamp axially in either direction through slightly less than 30 degrees. At this point, spring pressure will be felt on the inserted pins and the uninserted pins will be ready to insert. The second pins on each end should then be inserted and the rotation continued until the second pins have been rotated a full 90 degrees and spring detents in the sockets have been engaged. Removal of a lamp is accomplished though a reverse procedure.

To remove or install either category of tubular fluorescent lamps, the individual concerned must first gain access to them. When these lamps are mounted overhead and out of reach this may pose a considerable problem. The individual typically obtains a ladder or erects a platform or scaffold suitable to the task. For many individuals this presents a considerable inconvenience and may cause them to take short-cuts. These short-cuts, such as standing on tables or chairs, often tend to be unsafe.

Another problem exists concerning breakage of tubular fluorescent lamps. These lamps are constructed with thin-walled glass tubes. The use of these tubes, imposed by the nature of the lamps themselves, cause tubular fluorescent lamps to be inherently fragile. If struck even gently by a hard or sharp object, a glass tube may shatter, scattering small shards and leaving sharp edges.

Furthermore, these glass tubes are often quite long relative to their diameter. The application of even small lateral forces at or near the centers of these tubes may, through the leverage involved, cause the tubes to shatter. Surprisingly little lateral force is required to shatter the tubes.

The hazard posed by a shattered lamp may be considerably greater than that posed by a shattered incandescent lamp under similar conditions. In addition to the risk of laceration posed by the glass itself, the phosphors used to coat the insides of fluorescent lamp tubes are inherently toxic and present the additional risk of toxic reaction and inflammation.

Should one or more tubes shatter, the resultant shards and sharp edges pose a health hazard. This hazard is magnified should that lamp be overhead, as the resultant shards of phosphor-coated glass may precipitate upon an individual below the lamp, posing a direct danger to eyes and face, and torso should glass go down the person's neck.

If a tubular fluorescent lamp is removed or installed by hand, the health risk due to breakage is increased manyfold. Were the glass tubes to be inadvertently struck by a ring or tool, or were excessive lateral forces applied while grasping the lamp, it may shatter within the individual's hand. If the power is on, the danger of electrical shock or burns may also be present.

What is needed is a safe, easily implemented tool for the removal or installation of a variety of tubular fluorescent lamps, especially when such lamps are overhead or out of reach.

SUMMARY OF THE INVENTION

Accordingly, it is an advantage of the present invention that it is an improved tool for the manipulation of a variety of tubular fluorescent lamps.

Another advantage of the present invention may be realized through the use of an extension pole to extend the effective reach of an individual and eliminate the need for ladders or scaffolds when changing overhead lamps.

Also an advantage is that the present invention safely but firmly grips a tubular fluorescent lamp during removal and insertion, thus minimizing the likelihood of lamp breakage.

The above and other advantages may be achieved, in one form, by a tubular fluorescent lamp manipulation tool having a backplane with an axis parallel to the axis of the tubular fluorescent lamp and rigid along that axis, a lamp gripper joined to the backplane for firmly holding the lamp, and a coupler joined to the backplane for attachment of an external extension pole.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
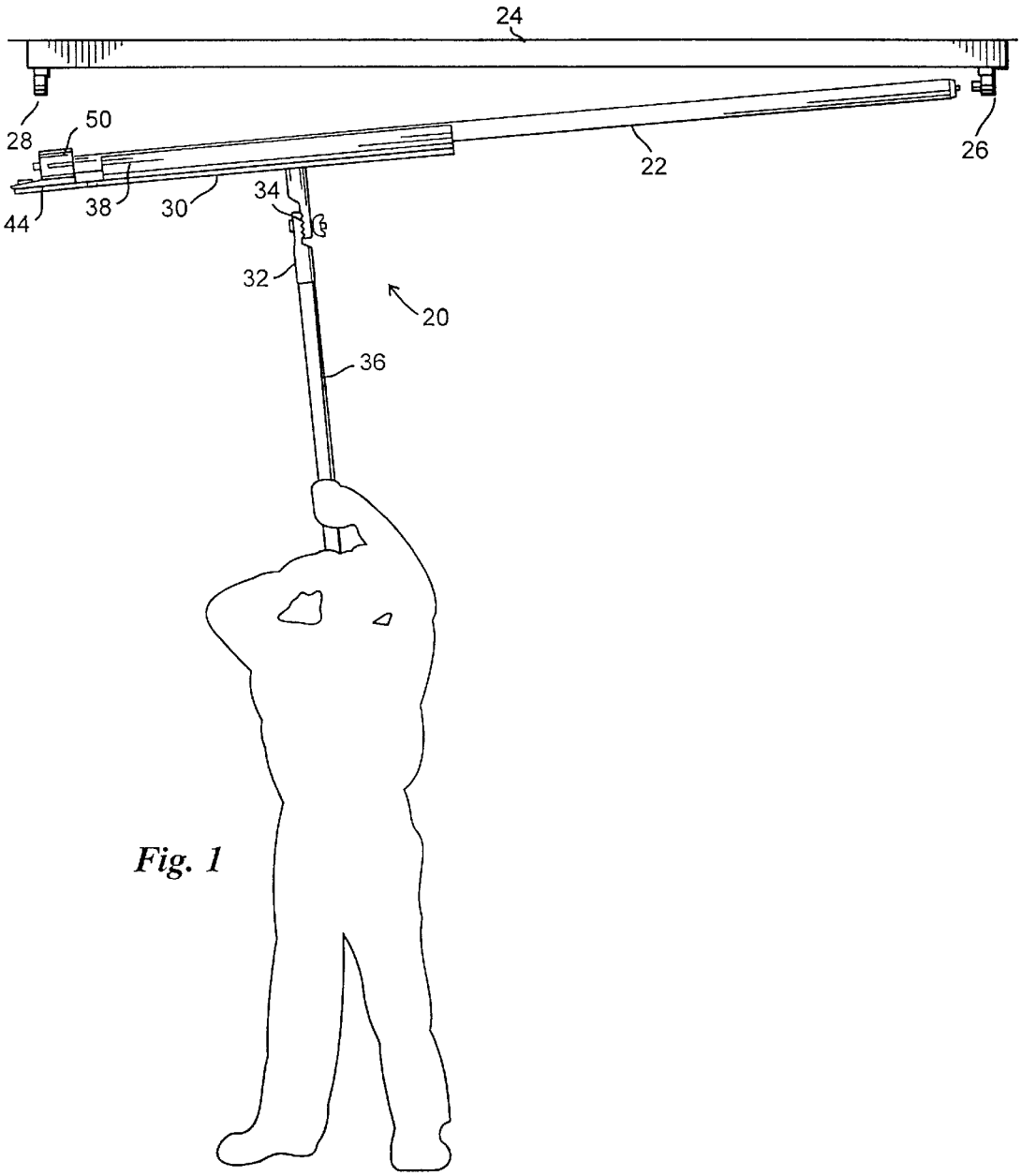
FIG. 1 shows a tubular fluorescent lamp manipulation tool in use during removal or installation of an axial-pressure tubular fluorescent lamp.

FIGS. 1–7 show a tubular fluorescent lamp manipulation tool 20 in use with an axial-pressure tubular fluorescent lamp 22. FIG. 1 shows tool 20 in use immediately after removal or immediately before installation of an overhead lamp 22 from a lamp fixture 24. The use of an extension pole 36 allows the user to reach lamp 22 even though it is well out of reach.

Extension pole 36 extends the reach of the user. By use of an appropriate extension pole 36, lamp 22 may be serviced at any reasonable height. The user can keep his or her feet safely on the floor while using the tool 20.

Lamp fixture 24 is standard in the industry. As shown in FIG. 1, our example fixture 24 includes a flat body and two lamp sockets, one at each end of fixture 24. One socket 28 is fixed, while the other socket 26 has a spring-loaded plunger mechanism the axial pressure from which retains lamp 22 in fixture 24.

Figure 2:
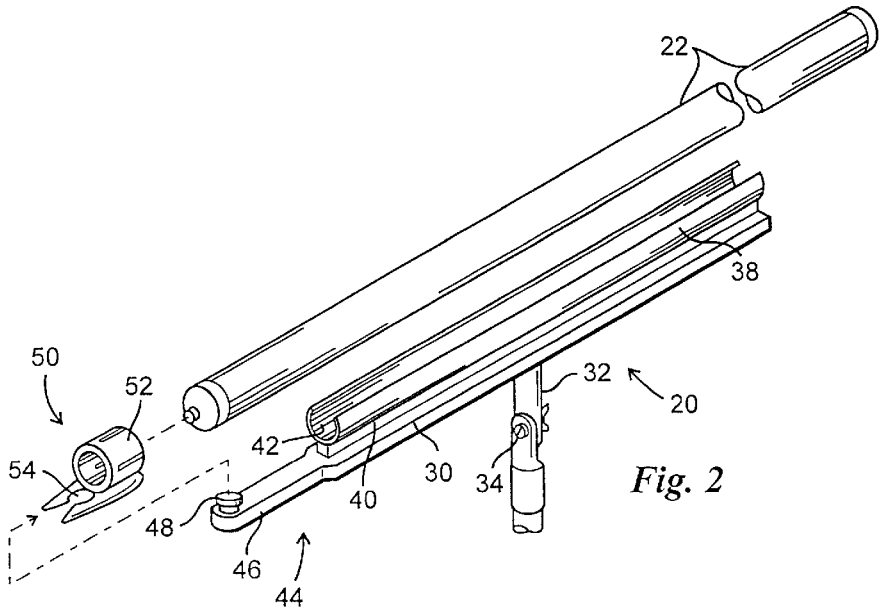
FIG. 2 shows an exploded isometric view of a tubular fluorescent lamp manipulation tool and an axial-pressure tubular fluorescent lamp.

FIG. 2 shows an isometric exploded view of a tubular fluorescent lamp manipulation tool 20 in cooperation with an axial-pressure tubular fluorescent lamp 22. Tool 20 includes a backplane 30, whose longitudinal axis is parallel to that of lamp 22 when lamp 22 is fully engaged in lamp gripper 38. In the preferred embodiment, backplane 30 is rigid along it longitudinal axis. By being rigid, backplane 30 will keep lamp gripper 38 straight so that it may easily engage lamp 22 without applying undue lateral pressure.

At the approximate midpoint 31 (see FIG. 2) of backplane 30 is joined a coupler 32 for attachment to an external extension pole 36. By attaching coupler 32 to backplane 30 at or near its midpoint 31, tool 20 will be balanced, hence easier to use with extension pole 36.

In the preferred embodiment, coupler 32 has a mechanism for angular adjustment 34. This mechanism 34 allows coupler 32 to be kept straight for use with overhead fixtures 24, or bent at right angles for use with wall-mounted fixtures 24.

Along the length of backplane 30 is fastened a lamp gripper 38. Lamp gripper 38 includes a segmental cylindrical structure 40 with a non-slip inner surface 42. This segmental cylindrical structure 40 is basically a hollow cylinder one side of which has been removed as though cut by a plane parallel to the axis of the cylinder. Thus, the portion remaining has a cross section perpendicular to its axis of a circular segment of greater than 180 degrees.

Inner surface 42 of structure 40 is, in the preferred embodiment, rendered non-slip relative to glass. This may be accomplished through textures, coatings, laminates, or the material of structure 40 itself. Those skilled in the art will appreciate that there are a myriad of ways of achieving this end.

The diameter of inner surface 42 of cylindrical structure 40 should, in the preferred embodiment be approximately equal to but at no time greater than the diameter of lamp 22. In this manner, lamp gripper 38 will, when fully engaged with lamp 22, hold lamp 22 firmly but safely.

When lamp 22 is fully engaged in lamp gripper 38, the axis of structure 40 is coincident with that of lamp 22. This allows the full area of inner surface 42 to be in contact with lamp 22, providing a maximum of cohesion between structure 40 and lamp 22.

At one end of backplane 30 is a lamp extractor 44. Extractor 44 includes an extractor extension 46 and an extraction stud 48 at the end of extension 46 farthest from backplane 30.

Over the end of lamp 22 there is an extraction endpiece 50. This endpiece 50 includes an endcap 52 and an engagement fork 54. In the preferred embodiment, endcap 52 is a short hollow cylinder whose inside diameter is slightly larger than the diameter of lamp 22. At one end of endcap 52 is an inside lip which prevents endcap 52 from slipping completely over lamp 22 while allowing the pin(s) of lamp 22 to protrude and be accessible.

Fork 54 is mounted onto the outside of endcap 52 in such a manner as to be tangent to endcap 52 and point away from lamp 22 when endcap 52 is placed upon lamp 22.

Fork 54 engages stud 48 during removal or installation of lamp 22. To this end, in the preferred embodiment, stud 48 is mounted at the end of extension 46 such that it aligns with fork 54 when endpiece 50 is on lamp 22 and lamp 22 is fully engaged in lamp gripper 38. Stud 48 includes a stem of a size to easily enter fork 54 and a button of a larger size to prevent fork 54 from slipping off stud 48 once engaged.

Figure 3:
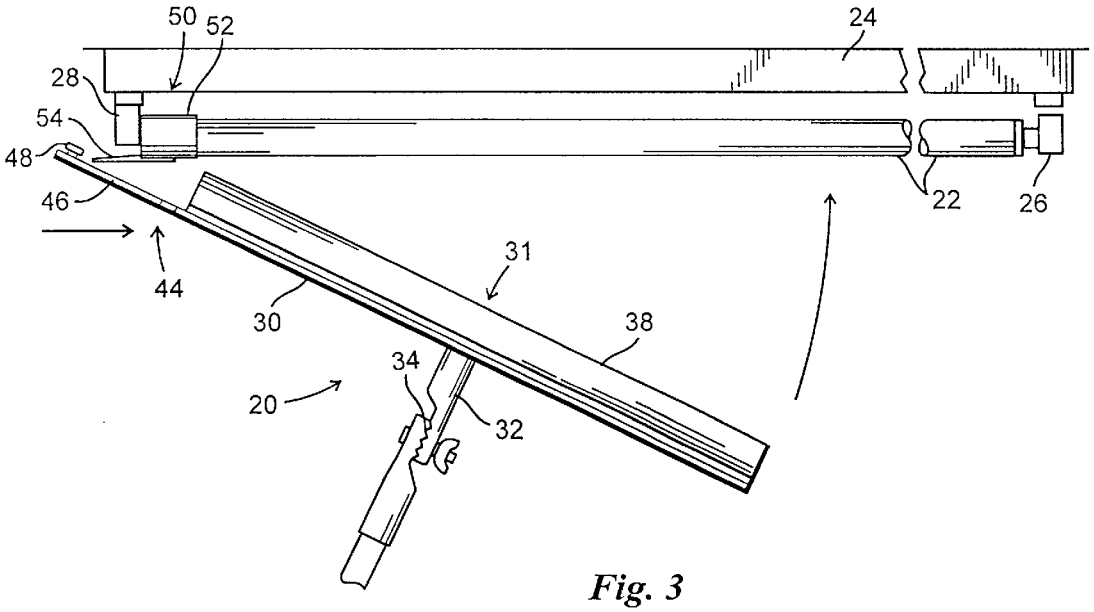
FIG. 3 shows a side view of a tubular fluorescent lamp manipulation tool engaged in axial-pressure tubular fluorescent lamp removal immediately prior to endpiece engagement.
Figure 4:
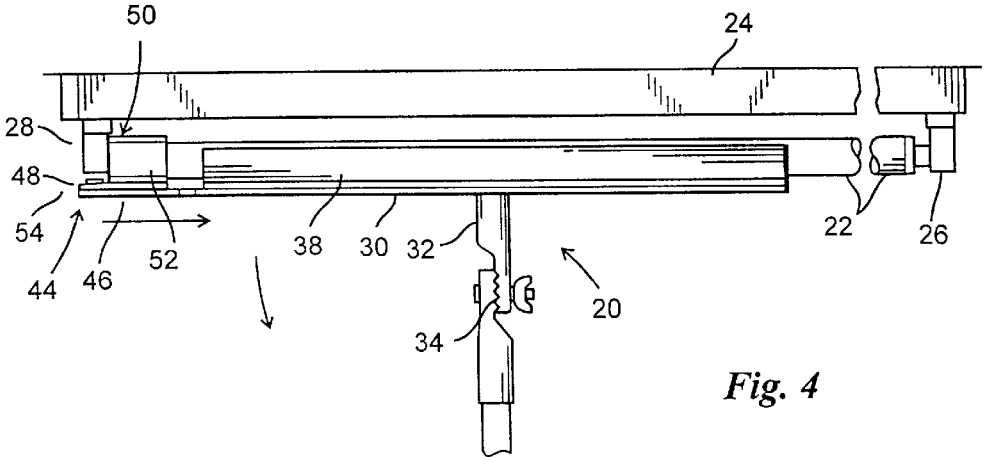
FIG. 4 shows a side view of a tubular fluorescent lamp manipulation tool engaged in axial-pressure tubular fluorescent lamp removal immediately prior to socket compression.
Figure 5:
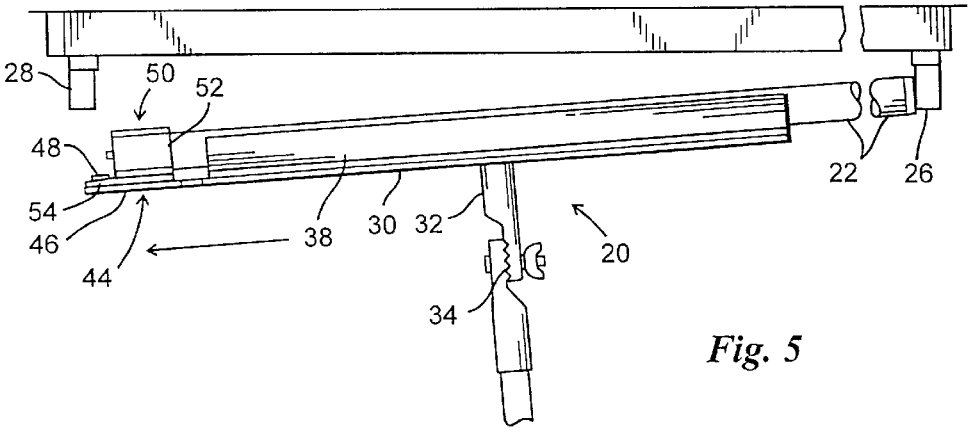
FIG. 5 shows a side view of a tubular fluorescent lamp manipulation tool engaged in axial-pressure tubular fluorescent lamp removal immediately prior to lamp disengagement.

Referring to FIGS. 3–5, removal of an axial-pressure tubular fluorescent lamp 22 from fixture 24 through the use of tubular lamp manipulation tool 20 is as described below. Assume extraction endpiece 50 has previously been placed upon lamp 22 in proper position, with engagement fork 54 on opposite side of lamp 22 from fixture 24.

Tool 20 is placed in the position shown in FIG. 3 relative to lamp 22. In this position, the axes of lamp 22 and backplane 30 lie in the same plane, with stud 48 adjacent to fork 54 and backplane 30 pointing at an angle away from lamp 22. Stud 48 of lamp extractor 44 is then engaged into engagement fork 54 of extraction endpiece 50. Backplane 30 is then swung upward towards lamp 22 until lamp 22 is fully engaged by lamp gripper 38. Tool 20 is now in the position shown in FIG. 4. Lamp 22 is then shifted towards plunger socket 26, disengaging lamp 22 from fixed socket 28. The end of lamp 22 disengaged from fixed socket 28 is then swung away from fixture 24 until clear of fixed socket 28. Tool 20 and lamp 22 are now in the position shown in FIG. 5. Lamp 22 is then shifted away from plunger socket 26 until lamp 22 is completely disengaged from fixture 24. Lamp 22 is then removed from lamp gripper 38 by swinging backplane 30 away from lamp 22, disengaging stud 48 from engagement fork 54, and removing extraction endpiece 50 from lamp 22 if desired. The removal of lamp 22 from fixture 24 has been completed.

Referring again to FIGS. 3–5, but in reversed order and with all directional arrows reversed, installation of an axial-pressure tubular fluorescent lamp 22 into fixture 24 through the use of tubular lamp manipulation tool 20 is as described below.

Endcap 52 of extraction endpiece 50 is placed over one end of lamp 22, if required. Extraction stud 48 of lamp extractor 44 is engaged in engagement fork 54 of extraction endpiece 50. Backplane 30 is then swung towards lamp 22 until lamp 22 is fully engaged in lamp gripper 38. The end of lamp 22 not associated with extraction endpiece 50 is then mated with plunger socket 26 of fixture 24 and shifted towards plunger socket 26 until the plunger is fully depressed. Tool 20 and lamp 22 are now in the position shown in FIG. 5. The end of lamp 22 associated with extraction endpiece 50 is shifted towards fixture 24 until the pin on the end of lamp 22 protruding through an opening (not shown) in endcap 52 is aligned with the hole (not shown) in fixed socket 28. Lamp 22 is then shifted towards fixed socket 28 until insertion of the pin is complete and lamp 22 is fully engaged in fixture 24. Tool 20 and lamp 22 are now in the position shown in FIG. 4. Backplane 30 is then swung away from lamp 30 until lamp 22 is fully disengaged from lamp gripper 38. Tool 20 is then shifted away from lamp 22 until stud 48 is free of fork 54. Tool 20 is now in the position shown in FIG. 3, and the installation of lamp 22 into fixture 24 has been completed. Extraction endpiece 50 remains on lamp 22.

Figure 6:
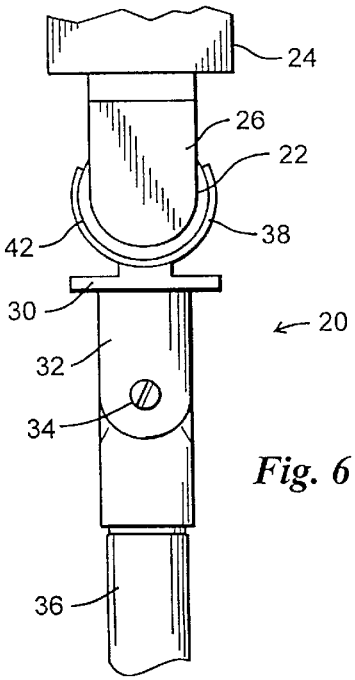
FIG. 6 shows an end view of a tubular fluorescent lamp manipulation tool removably attached to an axial-pressure tubular fluorescent lamp mounted overhead in a bulb-down position.

Mechanism for angular adjustment 34 of coupler 32 is used to adapt tool 20 for differing orientations of fixture 24. If fixture 24 were mounted overhead in a lamp-downward orientation, then mechanism 34 would be set to align both halves of coupler 32 linearly, the open slot of lamp gripper 38 would be opposite extension pole 36, and tool 20 would engage lamp 22 as shown in FIG. 6.

Figure 7:
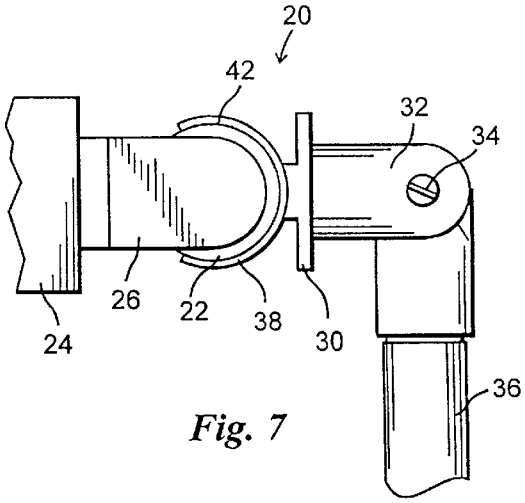
FIG. 7 shows an end view of a tubular fluorescent lamp manipulation tool removably attached to an axial-pressure tubular fluorescent lamp mounted on a wall in a horizontal position.

If, on the other hand, fixture 26 were wall mounted, then mechanism 34 would be set to align the halves of coupler 32 at right-angles to each other, the open slot of lamp gripper 38 would be at right angles to extension pole 36, and tool 20 would engage lamp 22 as shown in FIG. 7.

Figure 8:
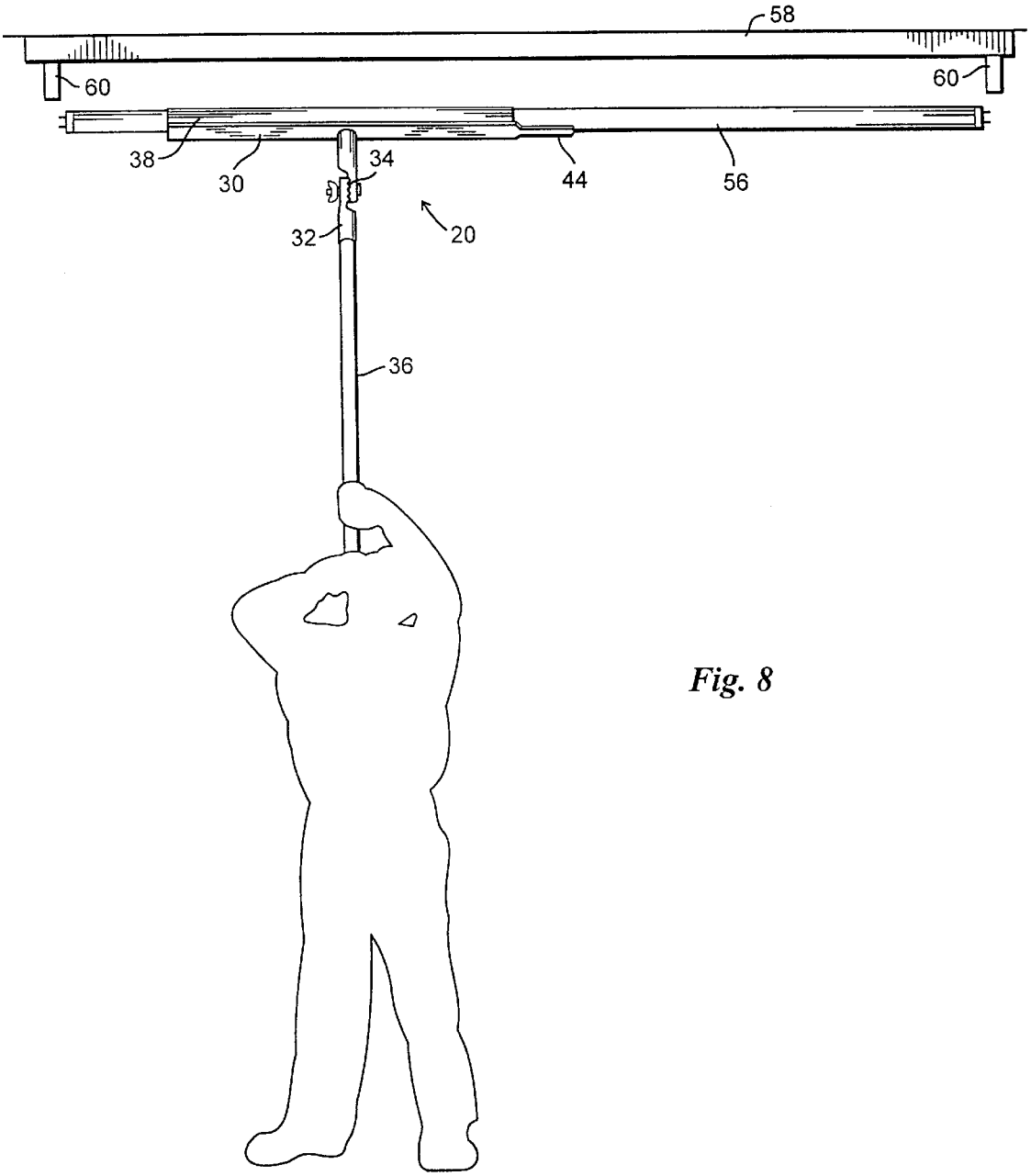
FIG. 8 shows a tubular fluorescent lamp manipulation tool in use during removal or installation of a twist-lock tubular fluorescent lamp.

FIGS. 8-11 show a tubular fluorescent lamp manipulation tool 20 in use with a twist-lock tubular fluorescent lamp 56. FIG. 8 shows tool 20 in use immediately after removal or immediately before installation of an overhead lamp 56 from a lamp fixture 58. The use of an extension pole 36 allows the user to reach lamp 56 even though it is well out of reach.

Lamp fixture 58 is standard in the industry. As shown in FIG. 8, our example fixture 58 includes a flat body and two fixed twist-lock lamp sockets 60, one at each end of fixture 58. The pressure applied by sockets 60 to the pins at each end of lamp 56 retains lamp 56 in fixture 58.

Figure 9:
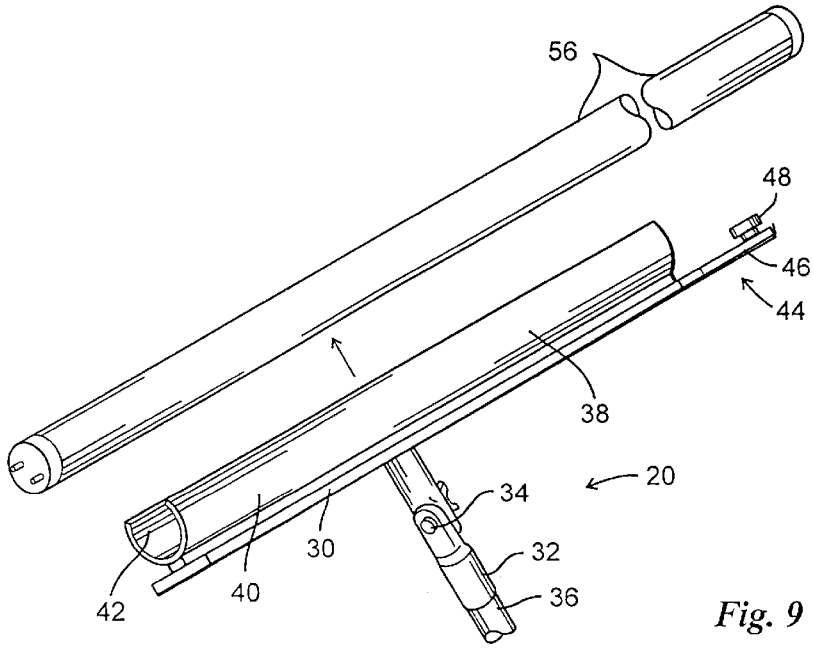
FIG. 9 shows an exploded isometric view of a tubular fluorescent lamp manipulation tool and a twist-lock tubular fluorescent lamp.

FIG. 9 shows an isometric exploded view of tubular fluorescent lamp manipulation tool 20 in cooperation with a twist-lock tubular fluorescent lamp 56.

Figure 10:
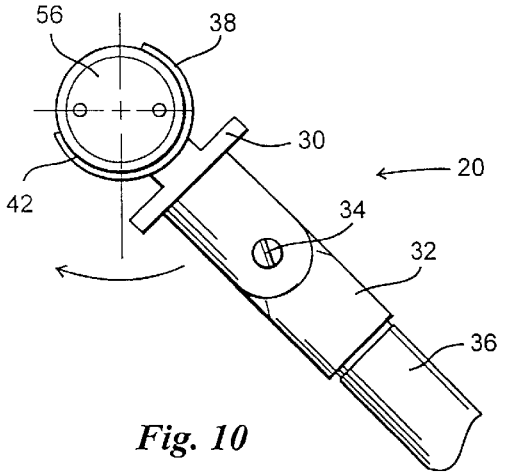
FIG. 10 shows an end view of a tubular fluorescent lamp manipulation tool removably attached to a twist-lock tubular fluorescent lamp prior to lamp disengagement.
Figure 11:
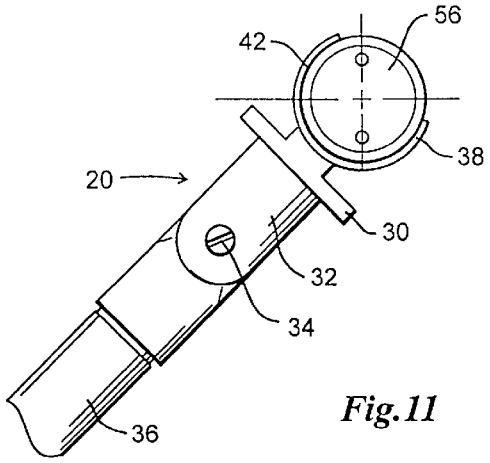
FIG. 11 shows an end view of a tubular fluorescent lamp manipulation tool removably attached to a twist-lock tubular fluorescent lamp after lamp disengagement.

Referring to FIGS. 9–11, removal of an axial-pressure tubular fluorescent lamp 56 from fixture 58 through the use of tubular lamp manipulation tool 20 is as described below.

Tool 20 is placed in such a position that one end of lamp gripper 38 is in contact with lamp 56 (similar to the position shown in FIG. 3), but preferably at an angle of approximately 45 degrees to the vertical. Backplane 30 is then swung upward towards lamp 56 until lamp 56 is fully engaged by lamp gripper 38. Tool 20 is now in the position shown in FIG. 10, preferably at an angle of 45 degrees to the vertical. Tool 20 is then rotated on the axis of lamp gripper 38 by slightly more than 60 degrees, at which time one pin on each end of lamp 56 will be in a position to leave sockets 60. Lamp 56 is then lowered slightly and rotation of tool 20 continued until the remaining pins of lamp 56 disengage from sockets 60. Tool 20 and lamp 56 are now as shown in FIG. 11. Backplane 30 is then swung away from lamp 56 until lamp 56 is fully disengaged from lamp gripper 38. The removal of lamp 56 from fixture 58 has been completed.

It may be noted that lamp extractor 44 is not used with twist-lock lamps 56, hence may be positioned mid-lamp and out of the way. For this reason, in the preferred embodiment it is desirable that extraction stud 48 not be so long as to touch the side of lamp 56 when in mid-lamp position.

Referring again to FIGS. 9–11, but in reversed order and with all directional arrows reversed, installation of a twist-lock tubular fluorescent lamp 56 into fixture 58 through the use of tubular lamp manipulation tool 20 is as described below.

Tool 20 is placed in such a position that one end of lamp gripper 38 is in contact with lamp 56, but at an angle of 45 degrees to the vertical. Backplane 30 is then swung upward towards lamp 56 until lamp 56 is fully engaged by lamp gripper 38. Tool 20 is now in the position shown in FIG. 11, preferably at an angle of 45 degrees, relative to the pins on lamp 56. One pin on each end of lamp 56 is inserted into sockets 60, and lamp 56 is gently raised towards fixture 58 while tool 20 is rotated slightly less than 30 degrees. At this point, a slight pressure will be felt on the inserted pins of lamp 56 and the uninserted pins will be ready to insert. The second pins on each end of lamp 56 should then be inserted into sockets 60 and the rotation of tool 20 continued until the second pins have been rotated a full 90 degrees and spring detents in sockets 60 have been engaged. Tool 20 and lamp 56 will now be in the position shown in FIG. 10. Backplane 30 is then swung away from lamp 56 until lamp 56 is fully disengaged from lamp gripper 38. The installation of lamp 56 into fixture 58 has been completed.

Tubular fluorescent lamps 22 and 56 come in T8 (1") and T12 (1½") diameters, among others. The diameter of inner surface 42 of segmental cylindrical structure 40 of lamp gripper 38 is preferably approximately the same as an no larger than the diameter of the specific lamp 22 or 56 to be removed or installed. Accordingly, differing versions of tool 20 may be used with lamps 22 or 56 of differing diameters.

Those skilled in the art will appreciate that inner surface 42 of segmental cylindrical structure 40 of lamp gripper 38 need not be non-slip if tool 20 is to be used solely with axial-pressure tubular fluorescent lamps 22. Similarly, lamp extractor 44 and extraction endpiece 50 are not required if tool 20 is to be used solely with twist-lock lamps 56. Those skilled in the art, therefore, may easily create variations of tool 20 for use with specific lamps.

In summary, tubular fluorescent lamp manipulation tool 20 fulfills the need for a safe and easy to use device for the removal and insertion of out-of reach tubular fluorescent lamps.

Although the preferred embodiment of the invention has been illustrated and described in detail, it will be readily apparent to those skilled in the art that various modifications may be made therein without departing from the spirit of the invention or from the scope of the appended claims.

What is claimed is:

1. A tool for removal and installation of a tubular fluorescent lamp, said tubular fluorescent lamp having a longitudinal axis and a predetermined diameter, and said tool comprising:

a backplane;

a lamp gripper joined to said backplane;

a lamp extractor joined to said backplane;

a coupler joined to said backplane for attachment of an external extension pole; and an extraction endpiece configured to engage said lamp extractor and to be placed on said tubular fluorescent lamp.

2. A tool for removal and installation of a tubular fluorescent lamp as claimed in claim 1 additionally comprising an extension pole attached to said coupler.

3. A tool for removal and installation of a tubular fluorescent lamp as claimed in claim 1 wherein said coupler has a mechanism for angular adjustment.

4. A tool for removal and installation of a tubular fluorescent lamp as claimed in claim 1 wherein:

said backplane has a midpoint; and said coupler is joined to said backplane at approximately said midpoint of said backplane.

5. A tool for removal and installation of a tubular fluorescent lamp as claimed in claim 1 wherein:

said backplane has a longitudinal axis parallel to said longitudinal axis of said tubular fluorescent lamp; and said backplane is rigid along said longitudinal axis thereof.

6. A tool for removal and installation of a tubular fluorescent lamp as claimed in claim 5 wherein said lamp gripper comprises a segmental cylindrical structure and said segmental cylindrical structure:

is hollow;

has in cross section a circular arc of greater than 180 degrees;

has an inner diameter approximately equal to said predetermined diameter of said tubular fluorescent lamp;

has a longitudinal axis substantially coincident with said longitudinal axis of said tubular fluorescent lamp; and is attached to said backplane.

7. A tool for removal and installation of a tubular fluorescent lamp as claimed in claim 6 wherein:

said segmental cylindrical structure additionally has an inner surface; and said inner surface is configured to be a non-slip surface relative to glass.

8. A tool for removal and installation of a tubular fluorescent lamp as claimed in claim 1 wherein said lamp extractor comprises:

an axial extension of said backplane; and an extraction stud mounted to said axial extension.

9. A tool for removal and installation of a tubular fluorescent lamp as claimed in claim 1 wherein said extraction endpiece comprises:

an endcap for placement upon an end of said tubular fluorescent lamp; and an engagement fork joined to one side of said endcap and positioned pointing away from said tubular fluorescent lamp in a direction parallel to said axis of said lamp.

* * * * *